US006454387B1

(12) United States Patent
Haldorsen

(10) Patent No.: US 6,454,387 B1
(45) Date of Patent: Sep. 24, 2002

(54) CAPILLARY LEAK INHIBITOR FOR A PRINT CARTRIDGE

(75) Inventor: Tom Haldorsen, Hillsboro, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/952,497

(22) Filed: Sep. 12, 2001

(51) Int. Cl.[7] ..... B41J 2/165; B41J 2/175; B41J 29/13

(52) U.S. Cl. ..... 347/29; 347/86; 347/87; 347/108

(58) Field of Search ..... 347/29, 108, 86, 347/87

(56) References Cited

U.S. PATENT DOCUMENTS 5,828,395 A * 10/1998 Takata ..... 347/86
5,886,721 A * 3/1999 Fujii et al. ..... 347/87
6,086,193 A * 7/2000 Shimada et al. ..... 347/86
6,170,941 B1 * 1/2001 Hara et al. ..... 347/86
6,260,961 B1 * 7/2001 Seu et al. ..... 347/87
6,290,346 B1 * 9/2001 Santhanam et al. ..... 347/86
6,302,534 B1 * 10/2001 Tsukahara et al. ..... 347/86
6,325,499 B1 * 12/2001 Betschon ..... 347/86

* cited by examiner

*Primary Examiner*—Andrew H. Hirshfeld
*Assistant Examiner*—Marvin P Crenshaw

(57) ABSTRACT

A lid for a print cartridge. The lid includes a barrier configured to seal the ink reservoir of the print cartridge and a stand-off spaced from the barrier. The stand-off is configured to engage ink-permeable foam. The lid may also include an alignment structure coupled with the stand-off and a capillary break adjacent the alignment structure. The capillary break is configured to impede the formation of capillary paths between the ink reservoir and the lid.

16 Claims, 3 Drawing Sheets

CAPILLARY LEAK INHIBITOR FOR A PRINT CARTRIDGE

FIELD OF THE INVENTION

The present invention relates generally to print cartridges and more particularly, to a print cartridge lid.

BACKGROUND

Print cartridges, or pens, are used in many printers. Typically, these print cartridges contain an ink reservoir or multiple ink reservoirs. Each reservoir may contain a foam interior that is saturated with ink. The ink contained within these reservoirs is intended to pass through the pen to media during printing. A lid as used herein is any component attached to the reservoirs. For example, a lid may be used to cover the reservoirs to prevent the ink from leaking out of the reservoirs.

One difficulty associated with such ink cartridges involves the challenge of keeping ink from leaking through joints between the lid and the reservoir. Ink leakage is a significant problem for a user because it may affect the quality of printing and make handling the ink cartridge difficult. For example, if ink does leak out of a reservoir, it may contaminate an adjacent reservoir (causing the colors of two reservoirs to mix). Furthermore, the ink may leak to the exterior of the pen. When such leakage occurs, a user who contacts the pen may be soiled by ink.

The cause of ink leakage may be liquid ink or ink-saturated foam contacting the joint between the reservoir and the lid. If the joints are not sealed then capillary forces may act to transport ink through the joints and to the exterior of the pen or to an adjacent reservoir. To avoid this problem, an internal wall may be used to keep the ink-saturated foam from coming in contact with the joints. Such an internal wall may also be used for other functions, such as alignment of the lid, strengthening of the lid, improvement of mold flow and lid dimensions. When these internal walls intersect with other walls or are in close proximity to another wall, then capillary forces may act to transport ink along the walls through capillary pathways. Ink may be drawn through these capillary pathways from the reservoir into adjacent reservoirs or to exterior surfaces of the print cartridge.

SUMMARY OF THE INVENTION

The present invention is directed to a lid for a print cartridge where the print cartridge has an ink reservoir configured to contain ink-permeable foam. The lid typically includes a barrier configured to seal the ink reservoir and a stand-off spaced from the barrier. The stand-off is configured to engage the ink-permeable foam. The lid may also include an alignment structure coupled with the stand-off, and a capillary break adjacent the alignment structure. The capillary break may be configured to impede or prevent the formation of capillary paths between the ink reservoir and the lid.

DETAILED DESCRIPTION OF THE INVENTION

Figure 1:
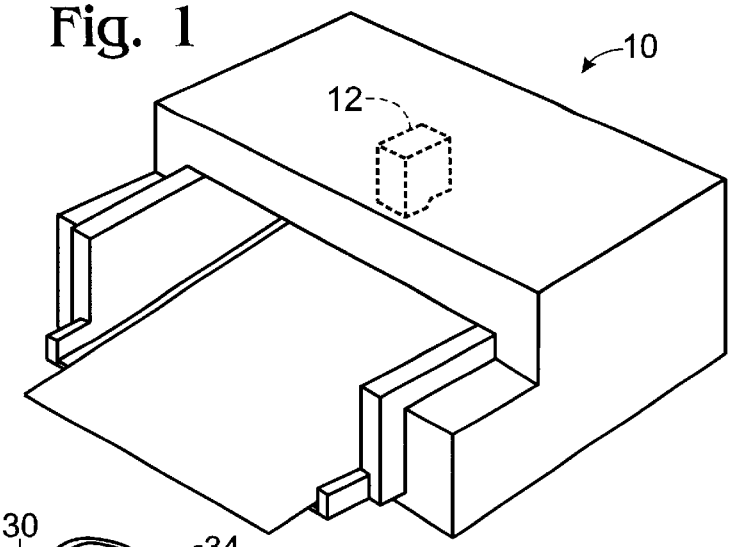
FIG. 1 is an isometric view of a printer showing a print cartridge constructed in accordance with one embodiment of the present invention.

Referring initially to FIG. 1, a printer is generally indicated at 10, such printer being representative of any suitable type of printer which employs a print cartridge or pen. As indicated, printer 10 includes a print cartridge (shown in phantom lines at 12) which may be supported on a carriage configured to pass across media as the media is drawn through the printer. Media may be fed through printer 10 using any suitable feeder such that the media passes under print cartridge 12. Print cartridge 12 is configured to deposit ink onto the media as the media passes below the print cartridge.

Figure 2:
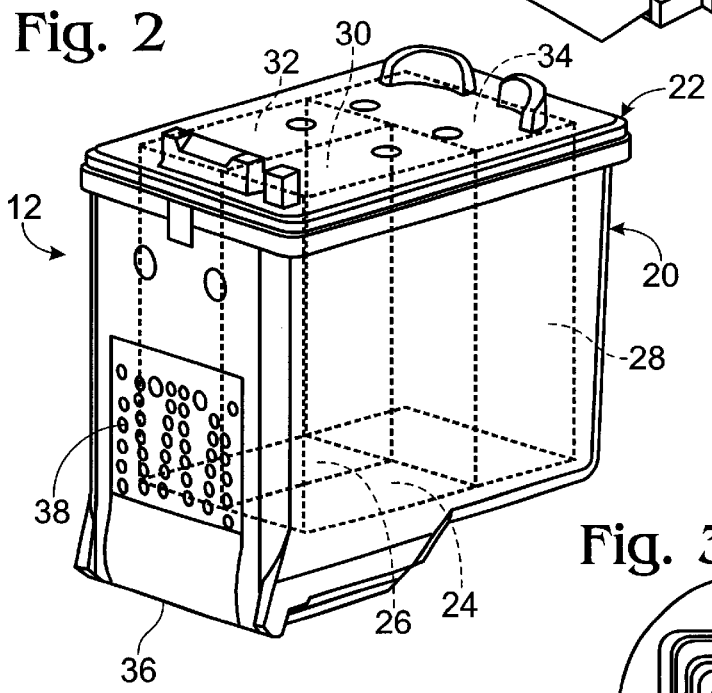
FIG. 2 is an isometric view of the pen of FIG. 1, showing a pen lid, a print cartridge body, and plural ink reservoirs in phantom lines.

Referring to FIG. 2, print cartridge 12 may include a print cartridge body 20 and a lid 22. Print cartridge body 20 defines ink containment regions or ink reservoirs. Print cartridge body 20 may have a single ink reservoir, or multiple ink reservoirs. In the present illustration, print cartridge body 20 has three ink reservoirs, 24, 26, and 28. Each ink reservoir may be filled with a permeable material, such as foam, or any other porous material which can absorb ink. The ink permeable foam in each reservoir nominally may be soaked with ink and may expand when ink is introduced into the reservoir such that the foam fills the reservoir defined by print cartridge body 20.

Print cartridge 12 may also include a printhead assembly 36 which is linked to ink reservoirs 24, 26, 28. Printhead assembly 36 defines ink channels and ink ejection chambers that control the regulated release of ink onto a medium during printing. A plurality of contact pads 38 are electrically aligned with contacts on the carriage when the print cartridge is installed to accommodate communication of operating instructions to the print cartridge.

Figure 3:
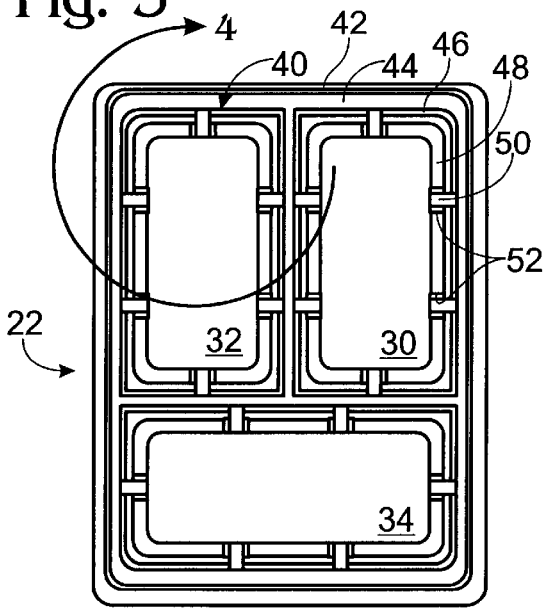
FIG. 3 is a simplified bottom view of the pen lid depicted in FIG. 2.

FIG. 3 illustrates the bottom of lid 22. Lid 22 covers ink reservoirs 24, 26, 28 such that the ink within the reservoirs is contained within a nominally sealed chamber. Thus, lid 22 may have corresponding sealing covers 30, 32, 34 which may be aligned with each ink reservoir. In the depicted print cartridge, lid 22 is a single integral unit, having separate regions which are intended to seal each ink reservoir. Lid 22 thus has three sealing regions 30, 32, and 34 which match with the three ink reservoirs 24, 26, 28, respectively. Each region seals the respective ink reservoir such that the ink is substantially contained within the reservoir.

The ink-permeable foam in each reservoir may contact corresponding foam engagement surfaces (also referred to as stand-offs) 48 of lid 22 within each sealing region 30, 32, and 34. Foam engagement surfaces 48, as described below, compress the foam such that the ink-permeable foam is fully contained within the appropriate reservoir. Additionally, lid 22 may be welded onto print cartridge body 20 in an attempt to seal print cartridge body 20.

Figure 4:
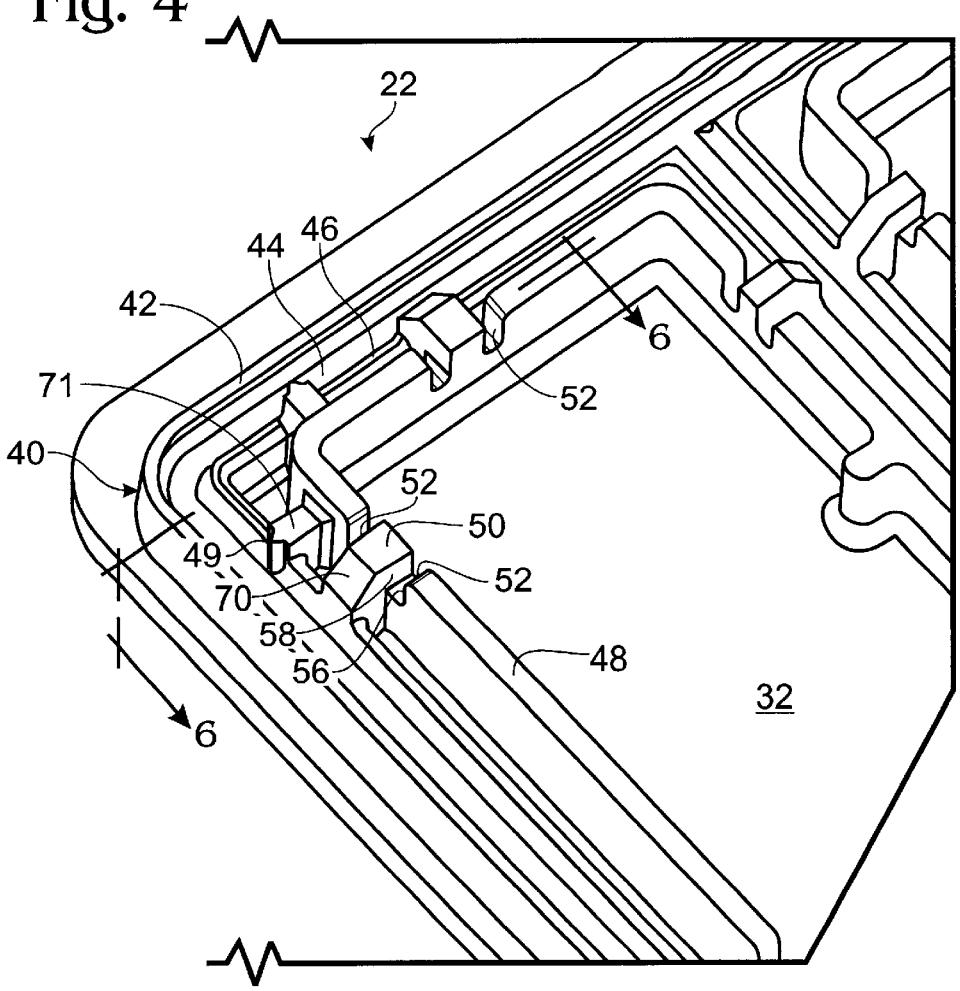
FIG. 4 is an enlarged fragmentary and bottom view of the lid depicted in FIG. 4, taken along line 4 in FIG. 3, and showing a stand-off wall, capillary breaks, alignment features and a reservoir seal.

The details of lid 22 are best illustrated in FIG. 4 which is an enlarged fragmentary view of the bottom of lid 22. Lid 22 includes a barrier, indicated generally at 40, which forms a seal about each ink reservoir. Barrier 40 may engage print cartridge body 20 in a tongue and groove fashion as shown. For example, barrier 40 may include spaced walls 42 and 46 which project outward from lid 22 defining a depressed region or groove 44 (also referred to as a sealing surface) there between. As illustrated, wall 42 may extend along the perimeter of all three ink reservoirs. Internal walls 46 may run along the interior of each ink reservoir. Groove 44 may align with a corresponding ridge (shown in FIG. 6 at 47) on print cartridge body 20. Alternatively, the groove may be integral with print cartridge body 20 and lid 22 may have a matching ridge.

Lid 22, as mentioned above, may include a stand-off 48 which projects outward away from the top of lid 22. Stand-off, as used herein, is a structure which is used to hold the ink-permeable foam at a distance away from the interface between lid 22 and print cartridge body 20. Stand-off 48 is a foam-engagement surface that is configured to push against the ink-permeable foam to prevent such foam from contacting the interface between print cartridge body 20 and lid 22. Stand-off 48 may be placed on the inside of barrier 40 such that stand-off 48 engages the ink-permeable foam contained within the ink reservoir. Thus, barrier 40 engages the walls of print cartridge body 20, which define each ink receptacles, while the stand-off engages the ink-permeable foam within the ink reservoir. As illustrated, stand-off 48 may follow the configuration of the ink reservoir.

Without stand-off 48, ink-permeable foam may contact the lid to body interface. The interface between lid 22 and print cartridge body 20 may be breached by ink, which through capillary action, may travel through barrier 40. The ink followscapillary paths which typically are found along intersecting walls which are in contact with the wetted foam. Typically, these capillary paths occur along sharp intersections (such as the juncture of two walls) or between two narrowly spaced walls, which form a capillary, and thus, a capillary path for the ink to travel. Stand-off 48 alleviates the capillary action caused by the intersecting walls of the lid, because stand-off 48 compresses the ink-permeable foam away from barrier 40 such that it is not in direct contact with the joint between lid 22 and print cartridge body 20.

However, stand-off 48 also may include additional structures, such as alignment structures 50, which in turn may provide new capillary paths. Alignment structures 50 are configured to aid in alignment of lid 22 with print cartridge body 20 during the assembly process. As. illustrated, alignment structure 50 includes an alignment wall 70. Alignment wall 70 may be sloped and is configured to aid in the alignment of lid 22. Additionally, reference structures 49 act as retention features to temporarily position and hold lid 22 in place during assembly of the pens. Surface 71 of reference structure 49 is configured such that it is not in contact with the ink. While the features of only one alignment structure 50 and associated capillary breaks 52 (described below) are labeled with reference designators in FIG. 4, it will be understood that the additional alignment structures and capillary breaks of similar construction may be employed.

Alignment structures introduce a potential disruption in stand-off 48. Alignment structures 50 may extend between stand-off 48 and barrier 40. Thus, as illustrated, alignment structures 50 may link stand-off 48 with internal walls 46. In previous configurations, alignment structures 50 were directly connected to stand-off 48 such that a continuous wall was formed. Such a configuration was problematic in regards to the potential for ink traveling across the interface, due to capillary action.

Figure 5:
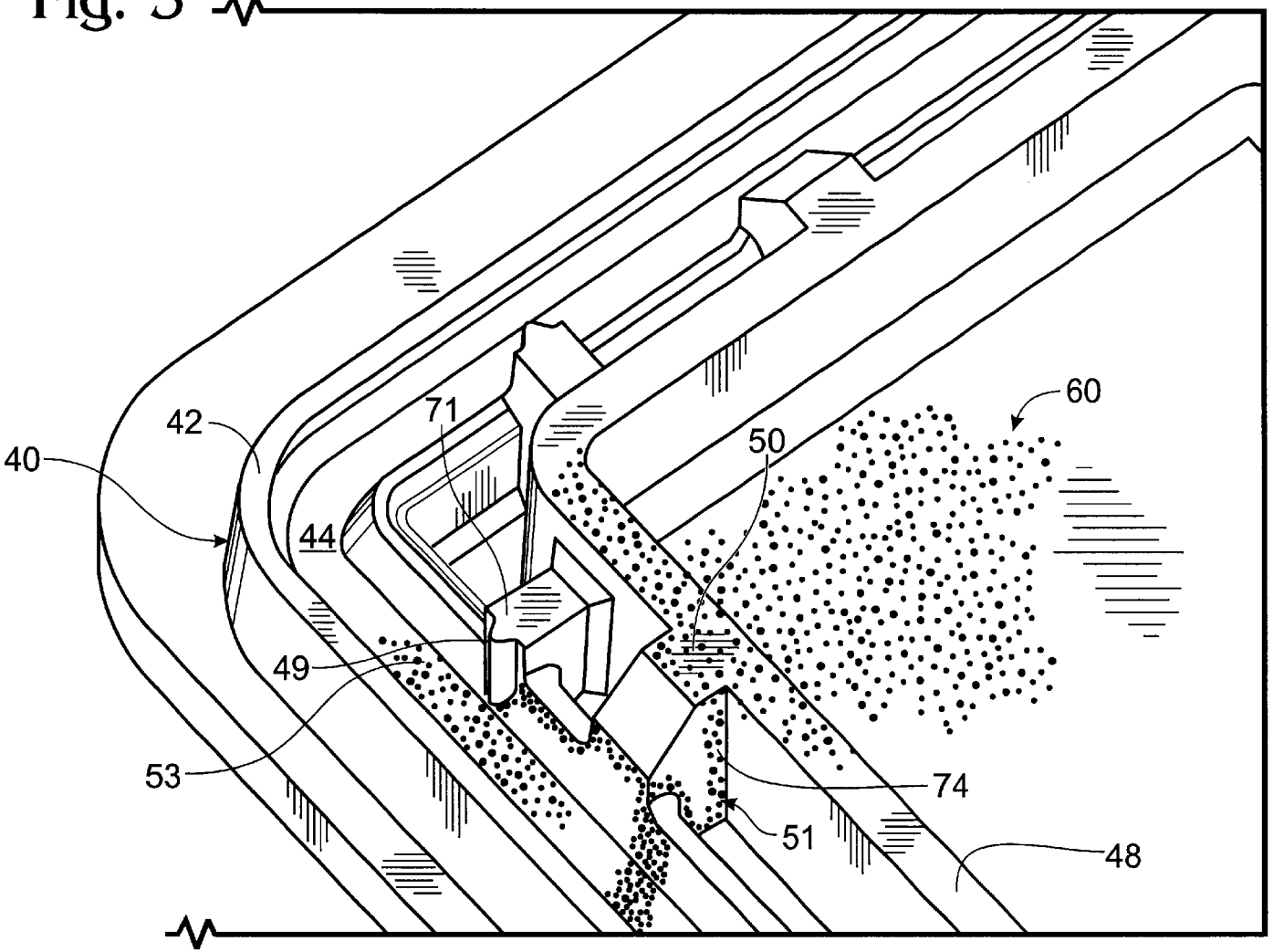
FIG. 5 is an enlarged fragmentary bottom view of a lid constructed according to previous known configurations, showing a capillary path that may occur due to the configuration of the lid.

For example in FIG. 5, a lid constructed according to previously known configurations is shown. Stand-off 48 and alignment structure 50 form a continuous wall which presses against the ink-permeable foam. The dots shown in FIG. 5 represent ink. As shown, ink 60 is in contact with stand-off 48 and the top surface of alignment structure 50. Ink 60 may leak along joint or juncture 74 where stand-off 48 abuts alignment structure 50. The ink leakage from the ink reservoir is generally shown by the capillary path indicated at 51. Thus, ink 60 through capillary action is able to penetrate both stand-off 48 and barrier 40. Ink 60 may be able to break through stand-off 48 because of alignment structures 50 which, when part of a continuous wall, form a capillary where the wall of alignment structure 50 meets the wall of stand-off 48. Since the ink-permeable foam, and thus the ink, is in contact with stand-off 48, ink 60 may be drawn through the capillary formed by the intersection of stand-off 48 and alignment structure 50. Hence, the capillary leakage is initiated along the juncture (74) of alignment structure 50 and stand-off 48. Ink 60 may then run through to reference structure 49, along internal walls 46 and through barrier 40. The ink may travel along each intersection where two walls meet at a sharp angle and along walls that are in close proximity to other walls, such as where the lid walls align with the print cartridge reservoir walls. These sharp angles and closely positioned walls form capillary paths that may transport ink to barrier 40. Thus, ink 60 may travel to barrier 40 (as illustrated at 53), and leak through joints (e.g. weld joints) which are not fully sealed, thereby mixing with different ink reservoirs (causing color mixing) or leaking onto the exterior of the print cartridge.

Figure 6:
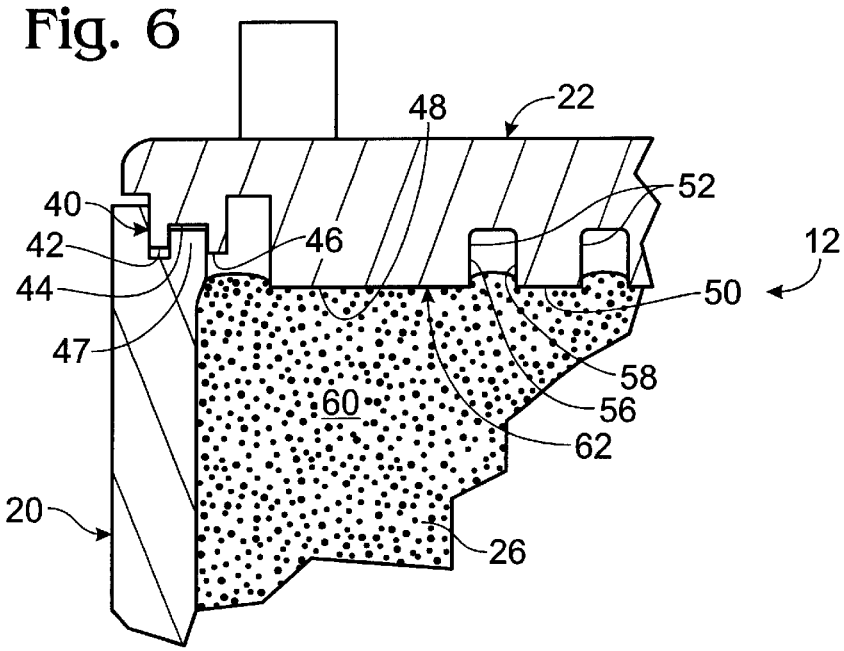
FIG. 6 is a further enlarged inverted sectional view of the lid of FIG. 4, taken along line 6—6 in FIG. 4, and showing the lid coupled with a print cartridge.

Referring back to FIG. 4, a capillary break 52 may be positioned within stand-off 48 to avoid capillary forces transporting ink along the intersection of stand-off 48 and alignment structure 50. Each capillary break may be adjacent to each alignment structure 50. As illustrated in FIG. 4 and 6, capillary break 52 is a cut-out of stand-off 48. Although illustrated as substantially rectangular and approximately one-third to one-half of the height of stand-off 48, the breaks may be of virtually any geometric size or shape that prevents ink from traveling along path 51 (as shown in FIG. 5) Each alignment structure 50 may have a pair of capillary breaks, which are positioned on each side thereof.

Each capillary break 52 is an interruption in stand-off 48 and prevents ink from traveling along path 51 by inhibiting the formation of capillary paths between alignment structure 50 and stand-off 48. Thus, as discussed above, and in the previous configurations of lid 22, sharply intersecting walls which are in contact with wetted foam, such as those between alignment structure 50 and stand-off 48, have a tendency to create a capillary that can draw ink from the ink reservoir to the exterior of the pen. Capillary breaks 52 mask the juncture between alignment structure 50 and stand-off 48. Thus, the isolation of alignment structure 50 from stand-off 48, due to the capillary breaks, effectively eliminates the intersection that created the capillary and capillary paths.

Referring to FIGS. 4 and 6, each capillary break 52 may be defined by the space between a first wall 56 and a second wall 58. First wall 56 may be the edge of stand-off 48 and second wall 58 may be a portion of alignment structure 50. The first and second wall must be spaced an appropriate distance to define a large enough gap to prevent capillary action within the break itself. The distance required to prevent capillary action may depend on the ink type itself. Typically, in a print cartridge which contain ink, the gap will be at least than 0.5 mm.

The first and second wall also must be spaced to prevent the ink-permeable foam from penetrating the break. Hence, capillary break 52 must be a small enough gap to prevent ink-permeable foam from expanding into it. If capillary break 52 is too large, the foam may expand into the break and contact the intersection between alignment structure 50 and stand-off 48. If the ink were to contact the intersection of alignment structure 50 and stand-off 48, the ink may follow a capillary path out of the reservoir (such path would be similar to the capillary path shown at 51 in FIG. 5). The width of the gap may depend on the properties of the ink-permeable foam. Typically, capillary breaks may be between 0.5–3 mm.

FIG. 6 is a fragmented view of print cartridge 12. More specifically, FIG. 6 is an inverted sectional view of lid 22 taken along line 6—6 in FIG. 4. In FIG. 6, lid 22 is coupled with print cartridge body 20. Ink 60 is shown contained within ink-permeable foam within an ink reservoir 26. Ink-permeable foam, and therefore ink 60 may contact an engagement structure 62 of lid 22. Engagement structure 62 includes stand-off 48 and alignment structure 50. Stand-off 48 and alignment structure 50 are both shown contacting ink-permeable foam. Alternatively, alignment structure 50 may be designed such that it does not extend as far outward from lid 22 as stand-off 48, and thus, may not itself contact foam 60.

Beyond alignment structure 50, barrier 40 acts as a seal between lid 22 and ink reservoir 32. Two capillary breaks 52 are shown adjacent to alignment structure 50. If capillary breaks 52 were not present, then capillary paths may run transverse to alignment structure 50, and permit ink 60 to leak through to barrier 40. However, capillary breaks 52 prevent the formation of these capillary paths because the ink does not contact any intersecting walls which potentially could form a capillary. By isolating the ink-permeable foam from the intersection between alignment structure 50 and stand-off 48, the capillary paths to barrier 40 may be eliminated. As described above, capillary breaks 52 are sized to prevent additional capillary action within the break itself and also sized to inhibit foam from penetrating the break. If the foam was able to penetrate the break and contact the juncture between stand-off 48 and alignment structure 50, then ink may likely leak along a newly formed capillary path.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

I claim:

1. In a print cartridge having an ink reservoir configured to contain ink-permeable foam, a lid comprising:

a barrier configured to form a seal between the lid and the ink reservoir;

a stand-off spaced from the barrier and configured to engage the ink-permeable foam;

an alignment structure coupled with the stand-off; and a capillary break defined by a first wall which is a portion of the stand-off and a second wall, spaced from the first wall, which is a portion of the alignment structure, the capillary break configured to impede the formation of capillary paths between the ink reservoir and the lid.

2. The lid of claim 1, wherein the capillary break is a gap between the stand-off and the alignment structure.

3. The lid of claim 1, wherein the capillary break is between approximately 0.5 mm and 3 mm.

4. The lid of claim 1, wherein the capillary break is sized to prevent the ink-permeable foam from penetrating the break.

5. The lid of claim 1, wherein the capillary break is sized to prevent capillary action within the break.

6. A print cartridge for a printer comprising:

a body having at least one ink reservoir containing an ink-permeable foam; and a lid coupled with the body and covering the ink reservoir, where the lid has a foam engagement surface, the engagement surface having an alignment structure and a first capillary break adjacent the alignment structure, the first capillary break being configured to inhibit capillary seepage of ink along the alignment structure.

7. The print cartridge of claim 6, wherein the lid includes a barrier configured to form a seal between the lid and the ink reservoir.

8. The print cartridge of claim 6, wherein the engagement surface extends around the interior of the ink reservoir.

9. The print cartridge of claim 6, wherein the alignment structure has a second capillary break adjacent the alignment structure such that the alignment structure is isolated from the engagement surface.

10. The print cartridge of claim 6, wherein the capillary break is approximately between 0.5 mm and 3 mm.

11. The print cartridge of claim 6, wherein the capillary break has a first wall and a second wall, and is sized to prevent capillary action between the first and second wall.

12. The print cartridge of claim 6, wherein the capillary break is sized to prevent foam penetration of the break.

13. An engagement structure for a lid of a print cartridge configured to prevent ink from leaking out of an ink reservoir, the engagement structure comprising:

a stand-off configured to engage an ink-permeable foam;

at least one alignment structure associated with the stand-off; and a capillary break adjacent the alignment structure extending substantially into the stand-off and configured to inhibit a liquid from wicking along the alignment structure.

14. The engagement structure of claim 13, wherein the stand-off extends from away from the underside of a print cartridge lid and is configured to keep the ink-permeable foam from contacting the underside of the lid.

15. The engagement structure of claim 13, wherein the capillary break is defined by a first wall which is a portion of the stand-off and a second wall, spaced from the first wall, which is a portion of the alignment structure.

16. The engagement structure of claim 13, wherein the capillary break is sized such that the ink-permeable foam does not contact the juncture between the stand-off and the alignment structure.

* * * * *